US008572881B2

(12) United States Patent
Samson et al.

(10) Patent No.: US 8,572,881 B2
(45) Date of Patent: Nov. 5, 2013

(54) MODULAR FIREARM ACCESSORY MOUNT

(75) Inventors: Scott W. Samson, Spofford, NH (US); Jonathan Bernashe, Sunderland, MA (US)

(73) Assignee: Samson Manufacturing Corporation, Keene, NH (US)

( * ) Notice: Subject to any disclaimer, the term of this patent is extended or adjusted under 35 U.S.C. 154(b) by 378 days.

(21) Appl. No.: 13/007,045

(22) Filed: Jan. 14, 2011

(65) Prior Publication Data

US 2011/0192068 A1 Aug. 11, 2011

Related U.S. Application Data

(60) Provisional application No. 61/295,511, filed on Jan. 15, 2010.

(51) Int. Cl.
*F41A 15/00* (2006.01)

(52) U.S. Cl.
USPC ..... 42/90; 42/128; 42/127; 42/148; 42/106

(58) Field of Classification Search
USPC ..... 42/90, 12, 128, 127, 148, 106
See application file for complete search history.

(56) References Cited

U.S. PATENT DOCUMENTS

| | | | | |
|---|---|---|---|---|
| 7,367,152 | B2 | 5/2008 | Samson | |
| 7,370,449 | B1 * | 5/2008 | Beckmann | 42/90 |
| 8,230,636 | B1 * | 7/2012 | Swan | 42/124 |
| 8,393,105 | B1 * | 3/2013 | Thummel | 42/90 |

* cited by examiner

*Primary Examiner* — J. Woodrow Eldred
(74) *Attorney, Agent, or Firm* — Burns & Levinson LLP; Bruce D. Jobse, Esq.

(57) ABSTRACT

A modular system for mounting firearm accessories includes a first accessory mounting member attachable directly to the firearm accessory and a second firearm mounting member to which first accessory mounting member may be removably joined. The first and second mounting members are frictionally engaged with interlocking barb(s) and a retention pin. One or more of barbs project from the first mounting member, each having a substantially rounded tip and a tapered or gradually decreasing diameter shaft, and are received within a complementary shaped aperture on the second mounting member. A retention pin disposed within a transverse channel in the second mounting member, and having corresponding area(s) of reduced diameter along the shaft thereof, is removably secured against the barb(s) at a right angle thereto when the barbs are received within the second mounting member, frictionally securing the two members together. The first mounting member may have various shapes and configurations, as well as attachment mechanisms, for securing a firearm accessory directly thereto prior to its engagement with the second mounting member on the firearm.

9 Claims, 4 Drawing Sheets

MODULAR FIREARM ACCESSORY MOUNT

CROSS REFERENCE TO RELATED APPLICATIONS

This application claims priority to U.S. Provisional Application Ser. No. 61/295,511 filed Jan. 15, 2010, entitled MODULAR FIREARM ACCESSORY MOUNT FOR USE WITH PIVOTING MOUNT ASSEMBLY, the disclosures of which is incorporated herein by this reference in its entirety for all purposes.

BACKGROUND OF THE INVENTION

The present invention relates generally to a mounting assembly for interfacing accessories with firearms.

A broad range of commercially available accessories are mountable onto a firearm to provide increased accuracy or broader functionality. Similarly, many accessories are available that are configured to be paired with another accessory wherein the combination provides for example telescopic sights, optical sights, night vision devices, range finding and illuminating devices, as well as various laser devices and directed fire equipment.

A number of different types and configurations of sight mounting devices allow the accessory to be removed from and replaced on to the firearm, each of which includes its own design problems. Most common is the time necessary to mount and dismount the firearm accessory from the firearm, particularly under realistic conditions.

Accordingly, a need exists for a mounting arrangement that gives the user the ability to easily and quickly deploy the desired firearm accessory in combat situations in a manner that is reliable and accurate with repeatable results.

SUMMARY OF THE INVENTION

A modular system for mounting firearm accessories includes a first accessory mounting member attachable directly to the firearm accessory and a second firearm mounting member to which first accessory mounting member may be removably joined. The first and second mounting members are frictionally engaged with interlocking barb(s) and a retention pin. One or more of barbs project from the first mounting member, each having a substantially rounded tip and a tapered or gradually decreasing diameter shaft, and are received within a complementary shaped aperture on the second mounting member. A retention pin disposed within a transverse channel in the second mounting member, and having corresponding area(s) of reduced diameter along the shaft thereof, is removably secured against the barb(s) at a right angle thereto when the barbs are received within the second mounting member, frictionally securing the two members together. The first mounting member may have various shapes and configurations, as well as attachment mechanisms, for securing a firearm accessory directly thereto prior to its engagement with the second mounting member on the firearm. In this manner, each firearm accessory secured to its own first mounting member may be rapidly mounted to or removed from the second mounting member and the firearm.

According to one aspect of the invention, a modular system for mounting firearm accessories comprises: A) a first accessory mounting member attachable to a firearm accessory; B) a second firearm mounting member attachable to a firearm; and C) a mechanism for releasably joining the first accessory mounting member to the second firearm mounting member.

According to another aspect of the invention, a method for attaching a firearm accessory to a firearm comprises: A) providing a modular system for mounting firearm accessories comprising: i) a first accessory mounting member, ii) a second firearm mounting member, and iii) a mechanism for releasably joining the first accessory mounting member to the second firearm mounting member; B) attaching the first accessory mounting member to the firearm accessory; C) attaching the second firearm mounting member to the firearm; and D) joining the first accessory mounting member to the second firearm mounting member.

BRIEF DESCRIPTION OF THE DRAWINGS

In the drawings:

FIG. 4 is a bottom, perspective view of the modular mount of FIG. 1 and the accessory receiver of the pivoting accessory mount of FIG. 3*b* illustrating the relationship there between.

DETAILED DESCRIPTION

Disclosed is a modular accessory mount that interfaces with an existing pivoting mount assembly on a firearm, or directly to a firearm, or to a firearm mounting assembly, such as a Rail system. The accessory mount allows the accessory to be reliably and repeatedly attached and re-attached to the firearm.

In accordance with the disclosure, a firearm accessory is fixed to a firearm with the inventive modular mount which, in the embodiment illustrated in FIG. 1A, includes a substantially L-shaped frame having two engagement prongs or barbs extending from a leg thereof along an axis substantially parallel to the axis of the firearm barrel. Each barbs contains a detent therein. The pivot mount assembly includes one or more cavities sized and shaped to receive the engagement barbs in a complementary mating manner. The pivot mount assembly further comprises a retention mechanism which, upon insertion of the engagement barb into one of the cavities, applies pressure on the barb thereby causing the modular mount and the firearm accessory associated with the modular mount to be fastly secured to the pivoting accessory mount. A release mechanism is attached to the pivoting accessory mount and allows for the retention mechanism to be selectively and rapidly released from the modular mount upon applying pressure thereto.

Figure 1:
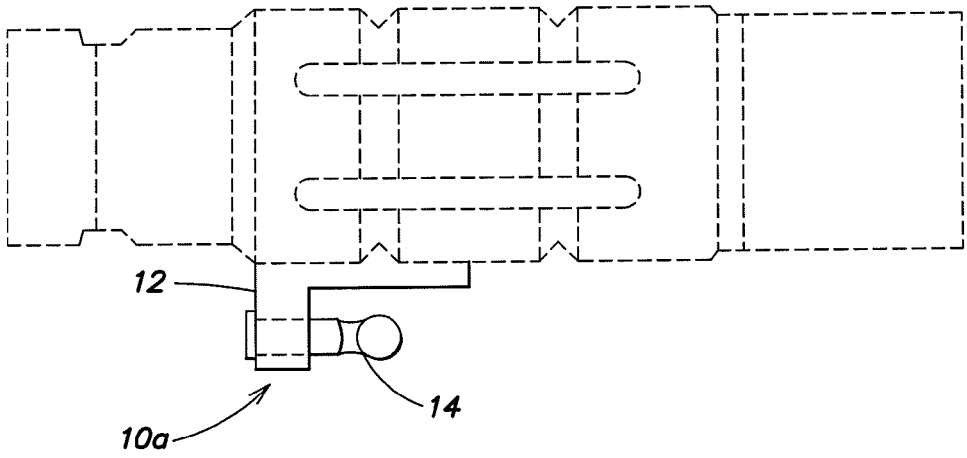
FIG. 1 is a side view of a first embodiment of the disclosed modular mount with a generic accessory to which it would be secured, illustrated in phantom.
Figure 2:
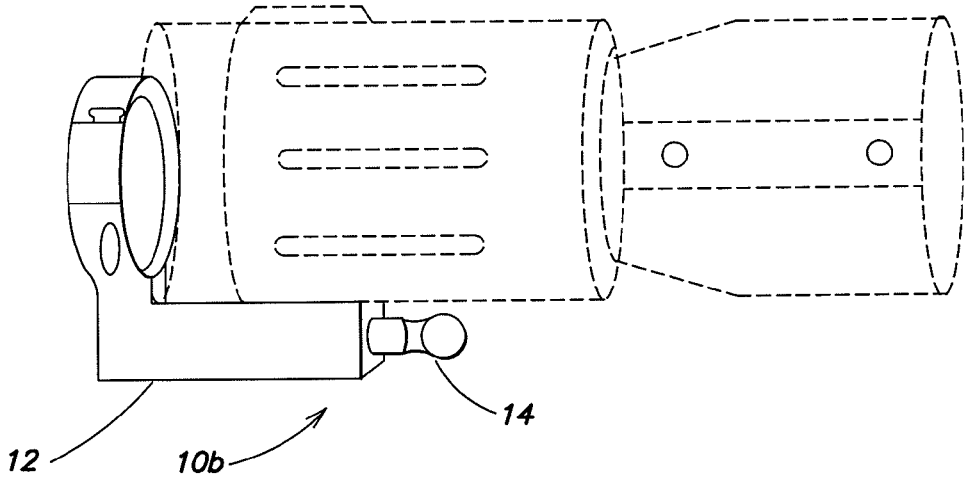
FIG. 2 is a side view of a second embodiment of the disclosed modular mount with a generic accessory to which it would be secured, illustrated in phantom.

Referring to the drawings, the novel firearm accessory mounting system(s) disclosed herein comprises a modular mount 10 securable to the firearm accessory and a complementary pivoting accessory mount system 20. A first embodiment of modular mount 10 is illustrated in FIG. 1. As illustrated, mount 10 comprises a substantially L-shaped rigid frame 12 having at least one prong or barb 14 projecting outwardly from one leg of the frame 12 and parallel to the axis of a firearm barrel. The other leg of the frame 12 is sized and shaped for removable mounting to a firearm accessory using any conventional coupling mechanisms, for example, screws, brackets, braces, clasps, clamps or any equivalent device suitable for coupling the firearm accessory to mount 10. Barbs 14 have indentations 14*a* formed therein to facilitate releasable engagement with system 10 or 20, as described hereafter. An alternative embodiment, mount 10*b*, is illustrated in FIG. 2. The mount 10*b* also has an L-shaped frame 12 having a pair of barbs 14 projecting outwardly from one leg of the frame 12. Barbs 14 of mount 10*b* are similar to that described with reference to mount 10*a*. The other leg of the frame 10*b* is sized and shaped for removably mounting a firearm accessory using a circular clamp securable about the end of the accessory. Any conventional coupling mechanisms, for example, screws, brackets, braces, clasps, or any equivalent device may likewise be used to secure the firearm accessory mount 10*b*.

In addition to the above configurations for brackets 10 and 10*b*, other configurations are also possible for frame 12, such as a U-shaped or O-shaped frame versus an L-shaped frame. Also, different engagement mechanisms may be in place of barbs 14. In addition, the angle at which the engagement mechanism secures to the pivoting mounting accessory may be at angles other than parallel to the firearm barrel. Also, frame 12 may have a single barb 14 or multiple barbs, in any frame configuration.

Figure 3A:
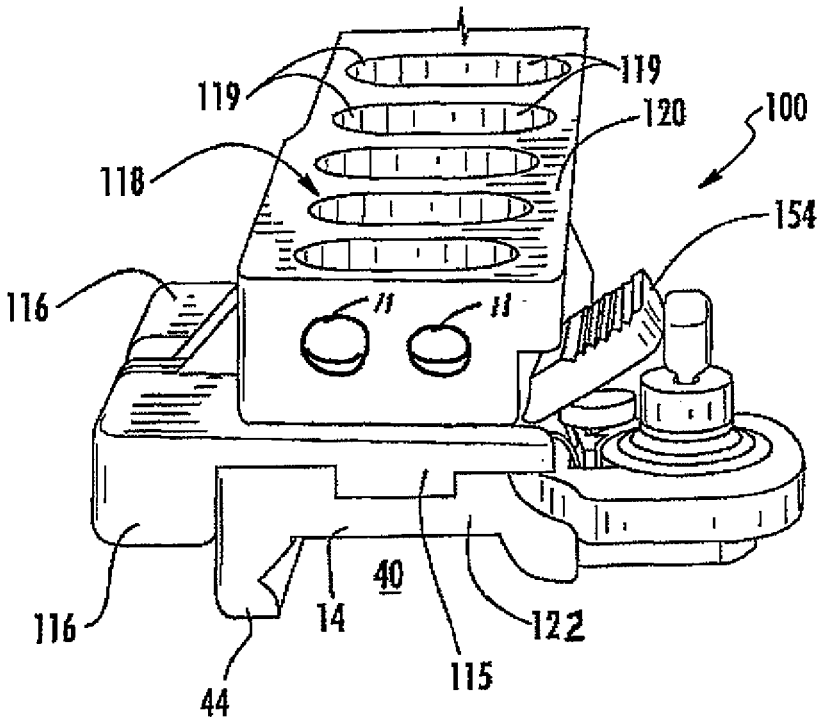
FIG. 3*a* is a front, perspective view of a pivoting accessory mount useful with the modular mounts illustrated in FIG. 1 and FIG. 2.
Figure 3B:
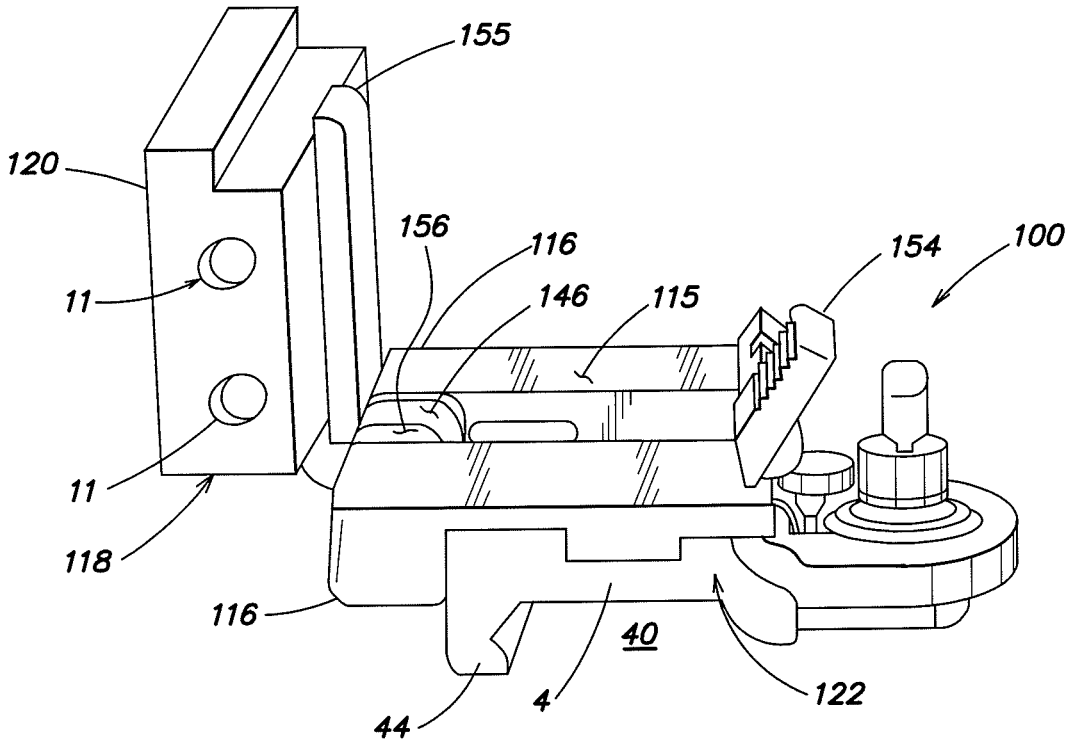
FIG. 3*b* is a front, perspective view of an alternative embodiment of the pivoting accessory mount of FIG. 3*a*.

FIGS. 3*a* and 3*b* depict a pivoting accessory mount 20 suitable for use with mounts 10 or 10*b*. One such pivoting accessory mount suitable for use with mounts 10*a-b* is described in U.S. Pat. No. 7,367,152, Samson, entitled Pivoting Mount for a Firearm Accessory. Another pivoting accessory mount suitable for use with mounts 10*a-b* is the Quick-Flip® PVS-14 Mount commercially available from Samson Manufacturing Corp. Whately, Mass. 01373.

As illustrated, pivoting accessory mount 20 comprises a mounting base 122 formed in two pieces wherein the lower portion 14 of the mounting base 122 is formed as a clamping member and functions as described above. The upper portion 115 of the mounting base 122 is configured to include at least one support element 116 extending outwardly to one side thereof. At least one support element 116 has a mounting shaft 146 that extends therefrom substantially parallel to the longitudinal axis and the barrel of the firearm when the pivoting accessory mount 100 is installed onto the firearm. The mounting shaft 146 is configured to receive and retain the accessory receiver 118 as will be described in more detail below. In this particular embodiment, the mounting base 122 can be seen to include first and second support elements 116 extending out to the side of the mounting base 122 from a forward and rearward edge thereof. In this case the mounting shaft 146 extends between and is supported by both the first and second mounting elements 116.

The accessory receiver 118 is pivotally mounted to the base member 122 such that when the base member 122 is attached to the firearm (not shown), the accessory receiver 118 can be pivoted between an engaged position (as is shown in FIG. 3*a*) and a disengaged position (as is shown in FIG. 3*b*). Generally, the axis around which the accessory receiver 118 pivots is aligned with and parallel to the longitudinal axis of the firearm (not shown). Additionally, the location of the mounting shaft 146 within the accessory mount 100 is again positioned such that the engaged position brings the accessory receiver 118 into a position above, for example, an interface rail of a firearm and the disengaged position allows the accessory receiver 118 to pivot to one side (preferably the side opposite the shell discharge port of the firearm), thereby positioning the accessory receiver 118 out of line of sight along the top of the firearm. This allows a clear line of sight for a user who desires to use the open sights of the firearm or a primary sighting device should the pivoting accessory mount 20 be holding a secondary sighting device.

The top portion 120 of the accessory receiver 118 serves as the interface between modular mounts 10 or 10*b* and mounting base 122. The top portion 120 of the accessory receiver 118 is formed as a mounting pad onto which a sighting device such as a scope is fastened. Fasteners such as screws (not shown) can be used to attach the accessory device to the top portion 120 of the accessory receiver 118 via holes 119.

In the disclosed embodiment, pivoting accessory mount 20 includes a locking means 154 provided at an edge of the mounting base 122 opposite the mounting shaft 146. The locking means 154 is operable to selectively retain or release the accessory receiver 118 thereby allowing the accessory receiver 118 to be reliably and selectively moved between an engaged position and a disengaged position. In particular, the locking mechanism 154 can be seen to be depressible in a manner that, when depressed, the locking mechanism 154 is displaced to allow a locking tab 155 on the accessory receiver to pass freely thereby allowing the accessory receiver 118 to be moved between the engaged and disengaged positions. A spring 156 is provided that urges the accessory receiver 118 to a disengaged position by applying a spring bias. Accordingly, when the locking mechanism 154 is depressed, the accessory receiver 118 is displaced to the disengaged position by the spring 156. Additionally, the locking means 154 is spring biased so that it returns back to its original position prepared to reengage the tab 155 as the accessory receiver 118 is returned to the engaged position. As was stated above, it should be appreciated that the locking function may also be performed using any other methods known to those skilled in the art and still fall within the scope of the present invention.

Figure 4:
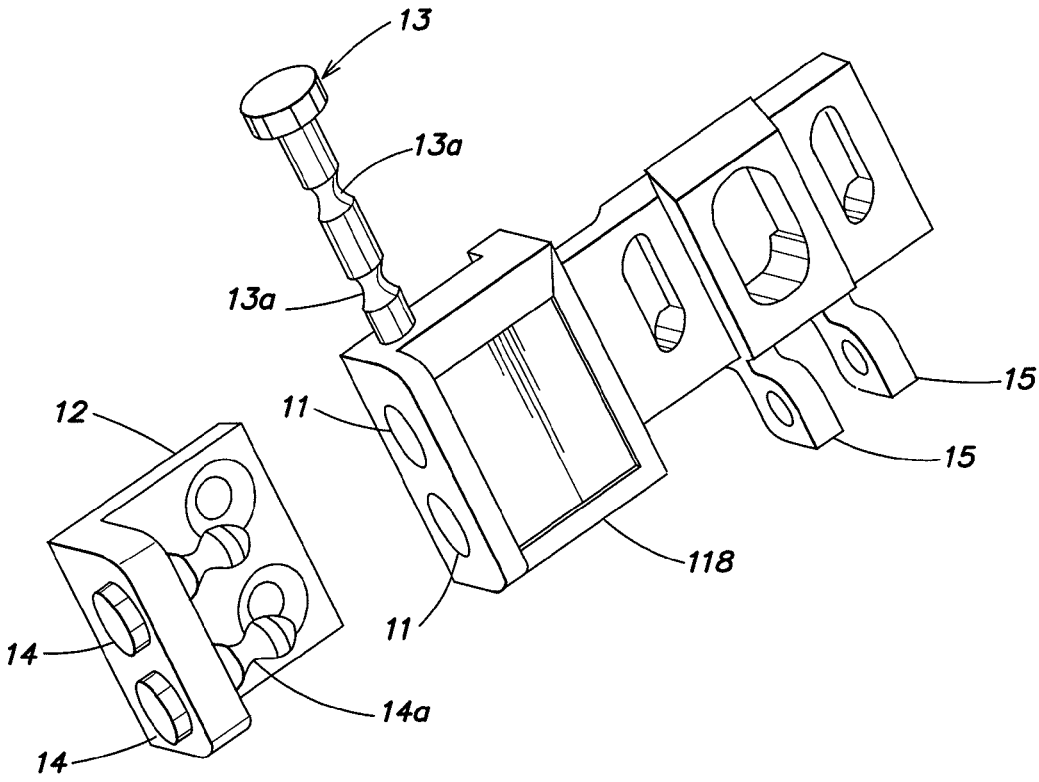

FIG. 4 is a bottom, perspective view of the modular mount 10 of FIG. 1*a* and the accessory receiver of the pivoting accessory mount 100 of FIG. 3*b* illustrating the relationship there between. As illustrated, a pair of apertures or cavities 11 extends into accessory receiver 118 and is shaped and sized to receive a complementary mating pair of barbs 14 of either mount 10*a* or 10*b* so that detents 14*a* of barbs 14 are engaged by the retention mechanism 13 which includes complementary mating detents 13*a* when inserted into cavities 11. Retention mechanism 13 has a general pin-type shape and is removably received within accessory receiver 118 through a third cavity therein disposed normal to the cavities designed to accommodate barbs 14, as illustrated. Accessory receiver 118 further includes pair of loops 15 for pivotally mounting to first and second mounting elements 116 of assembly 20, in a manner similar to that described with reference to the embodiments of FIGS. 3*a-b*.

It can therefore be seen that the present invention provides a reliable and easy to use pivoting accessory mount for a firearm that serves not only to allow an accessory to be quickly and reliably moved between a disengaged position and an engaged position while eliminating the need for recalibration and alignment, but also to be quickly engaged and disengaged from the pivoting mount assembly. Utilizing the modular mounting system disclosed herein, these activities can be done manually without the need for tools. Further, the present modular mounts 10*a* and 10*b* can be modified to accommodate a number of different types of firearm accessories.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. A modular system for mounting firearm accessories comprising:

A) a first accessory mounting member attachable to a firearm accessory;

B) a second firearm mounting member attachable to a firearm; and

C) a mechanism for releasably joining the first accessory mounting member to the second firearm mounting member;

wherein the mechanism for releasably joining comprises at least one barb projecting from the first accessory mounting member, the barb having a substantially rounded tip and an area of reduced diameter.

2. The system of claim 1 wherein the mechanism for releasably joining further comprises an aperture extending at least partially through the second firearm mounting member and shaped to receive the barb of the first accessory mounting member.

3. The system of claim 2 wherein the mechanism for releasably joining further comprises:

a transverse channel extending partially through the second mounting member, and a retention pin having a shaft and removably disposed within the transverse channel, the retention pin having at least one area of reduced shaft diameter for contacting the corresponding area of reduced shaft diameter of the barb.

4. The system of claim 1 wherein the mechanism for releasably joining comprises a plurality of barbs projecting from the first accessory mounting member, the barbs each having a substantially rounded tip and an area of reduced shaft diameter.

5. The system of claim 4 wherein the mechanism for releasably joining further comprises a plurality of apertures each extending at least partially through the second firearm mounting member and shaped to receive one of the plurality of barbs of the first accessory mounting member.

6. The system of claim 2 wherein mechanism for releasably joining further comprises:

a transverse channel extending partially through the second mounting member, and a retention pin having a shaft and removably disposed within the transverse channel, the retention pin having a plurality of areas of reduced shaft diameter for contacting the corresponding area of reduced shaft diameter of each of the plurality of barbs.

7. The system of claim 1 wherein the first accessory mounting member has any of an L-shape, U-shape, or O-shape portion thereof.

8. The system of claim 1 wherein second firearm mounting member is removably mounted to the firearm.

9. A method for attaching a firearm accessory to a firearm comprising:

A) providing a modular system for mounting firearm accessories comprising:

i) a first accessory mounting member, ii) a second firearm mounting member, and iii) a mechanism for releasably joining the first accessory mounting member to the second firearm mounting member wherein the mechanism for releasably joining comprises at least one barb projecting from the first accessory mounting member, the barb having a substantially rounded tip and an area of reduced diameter;

B) attaching the first accessory mounting member to the firearm accessory;

C) attaching the second firearm mounting member to the firearm; and

D) joining the first accessory mounting member to the second firearm mounting member.

* * * * *

UNITED STATES PATENT AND TRADEMARK OFFICE

CERTIFICATE OF CORRECTION

PATENT NO. : 8,572,881 B2
APPLICATION NO. : 13/007045
DATED : November 5, 2013
INVENTOR(S) : Scott W. Samson et al.

It is certified that error appears in the above-identified patent and that said Letters Patent is hereby corrected as shown below:

In the Claims:

Column 5, line 32 (Claim 4), the portion of the line reading "substantially rounded tip and an area of reduced shaft diameter." should read -- substantially rounded tip and an area of reduced diameter --

Signed and Sealed this
Seventeenth Day of December, 2013

Margaret A. Focarino

Margaret A. Focarino
*Commissioner for Patents of the United States Patent and Trademark Office*